US007944397B2

(12) United States Patent
Lee et al.

(10) Patent No.: US 7,944,397 B2
(45) Date of Patent: May 17, 2011

(54) CHIP ANTENNA

(75) Inventors: Jae-Man Lee, Goyang-si (KR); Sae-Won Oh, Incheon (KR); Seung-Yong Lee, Pucheon-si (KR)

(73) Assignee: Ace Antenna Corp., Incheon (KR)

( * ) Notice: Subject to any disclaimer, the term of this patent is extended or adjusted under 35 U.S.C. 154(b) by 441 days.

(21) Appl. No.: 12/067,796

(22) PCT Filed: Sep. 22, 2006

(86) PCT No.: PCT/KR2006/003785

§ 371 (c)(1), (2), (4) Date: Mar. 21, 2008

(87) PCT Pub. No.: WO2007/035064

PCT Pub. Date: Mar. 29, 2007

(65) Prior Publication Data

US 2008/0224946 A1 Sep. 18, 2008

(30) Foreign Application Priority Data

Sep. 23, 2005 (KR) ..... 10-2005-0088706
Sep. 23, 2005 (KR) ..... 10-2005-0088726
Dec. 30, 2005 (KR) ..... 10-2005-0134843

(51) Int. Cl.
*H01Q 1/38* (2006.01)

(52) U.S. Cl. ..... 343/700 MS; 343/702; 343/895

(58) Field of Classification Search ..... 343/700 MS, 343/702, 895

See application file for complete search history.

(56) References Cited

U.S. PATENT DOCUMENTS 5,153,600 A * 10/1992 Metzler et al. ..... 343/700 MS
5,510,803 A * 4/1996 Ishizaka et al. ..... 343/700 MS
6,819,289 B2 * 11/2004 Kim et al. ..... 343/700 MS

FOREIGN PATENT DOCUMENTS

EP 1178565 B1 2/2002
EP 1198027 B1 4/2002
KR 1020000001559 A 1/2000
KR 1020030092735 A 12/2003

OTHER PUBLICATIONS

International Search Report, Application No. PCT/KR2006/003785, mailed Jan. 10, 2007.

* cited by examiner

*Primary Examiner* — Hoang V Nguyen
(74) *Attorney, Agent, or Firm* — LRK Patent Law Firm

(57) ABSTRACT

The present invention relates in general, to a chip antenna and, more particularly, to a dual-band small-sized chip antenna, in which a first antenna element, including a plurality of coil members, is coupled with a second antenna element, having a plurality of circuit patterns, in a zigzag fashion, thus forming resonance frequencies, and relates to a multi-band chip antenna fed with current from external part wherein the third antenna element having coil formed in helical form and the fourth antenna formed parallel with the third antenna element and in helical form are connected to the fifth antenna having a plurality of circuit pattern on the layered-substrate, and relates to chip antenna using multi-layered radiator to generate the mutual coupling of two radiator by placing non-feeding radiation element having fixed pattern between the radiator for performing the radiation of the low frequency band and the radiator for performing the radiation of the high frequency band and to have wide band characteristic by forming multiple current path to radiator.

6 Claims, 15 Drawing Sheets

[fig. 1]
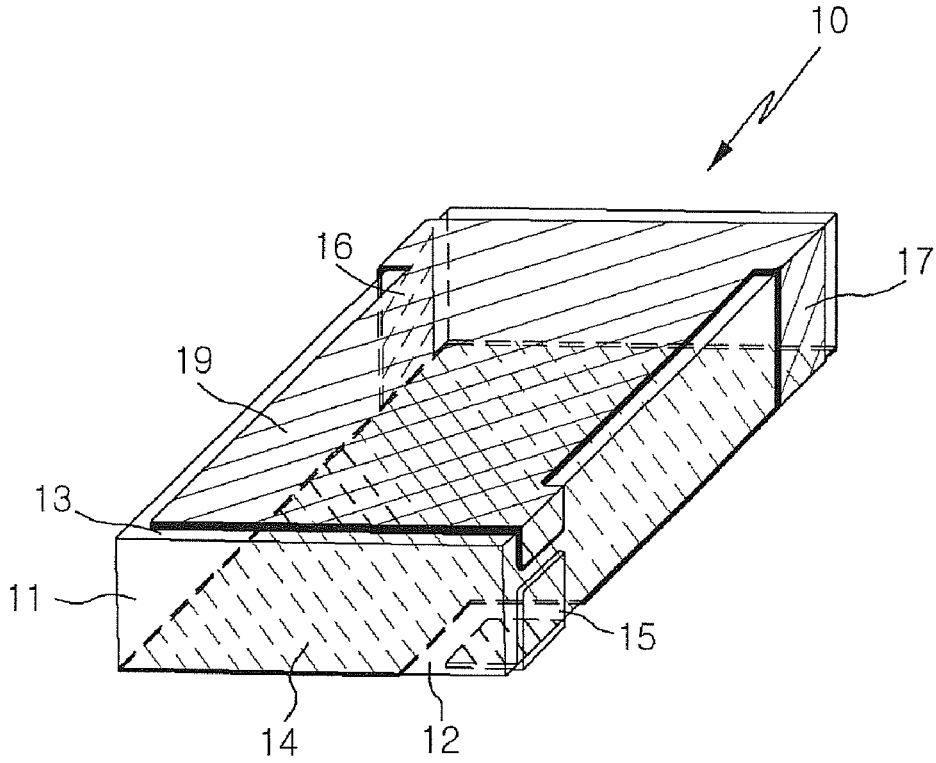

【fig. 2】
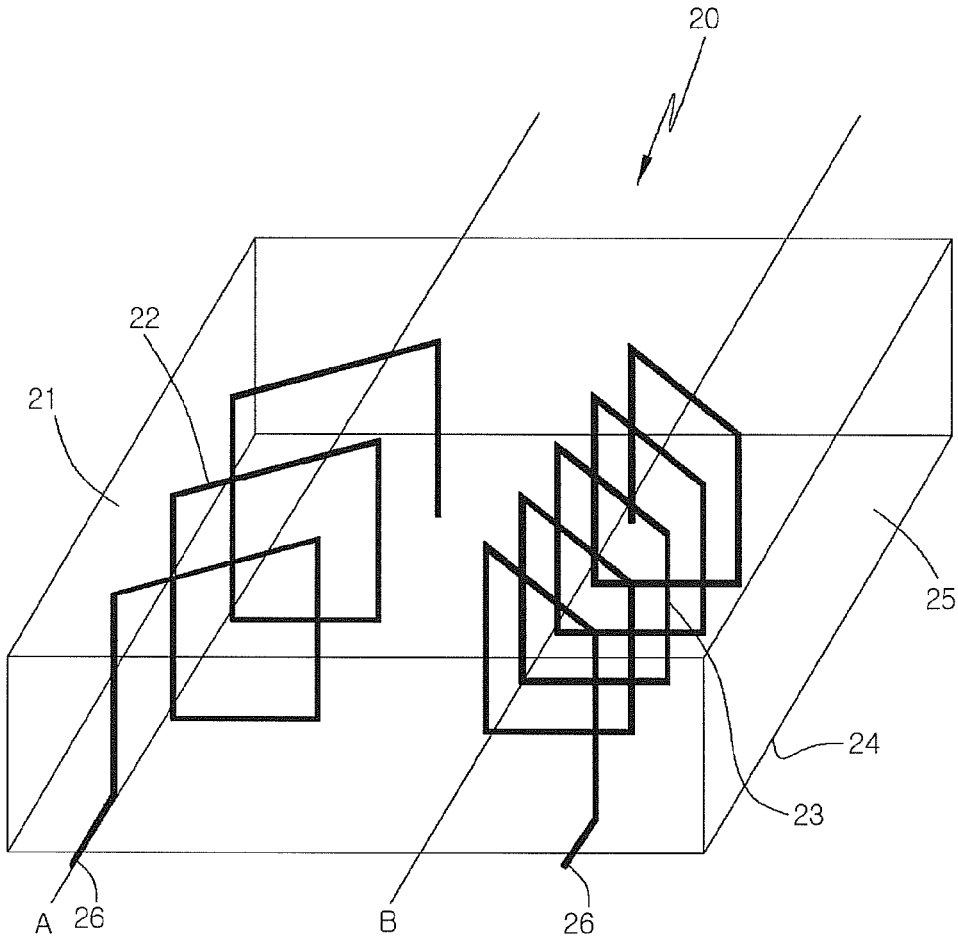

【fig. 3】
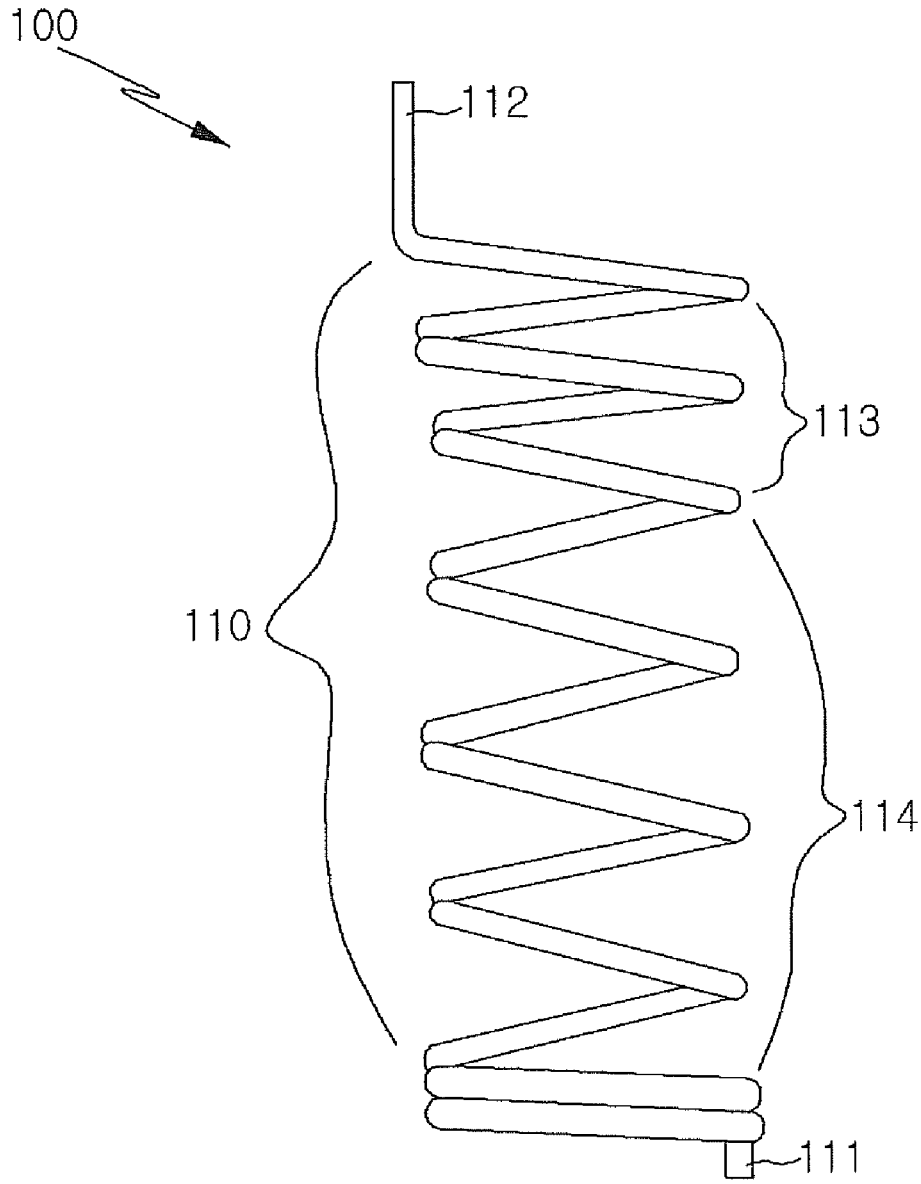

【fig. 4a】
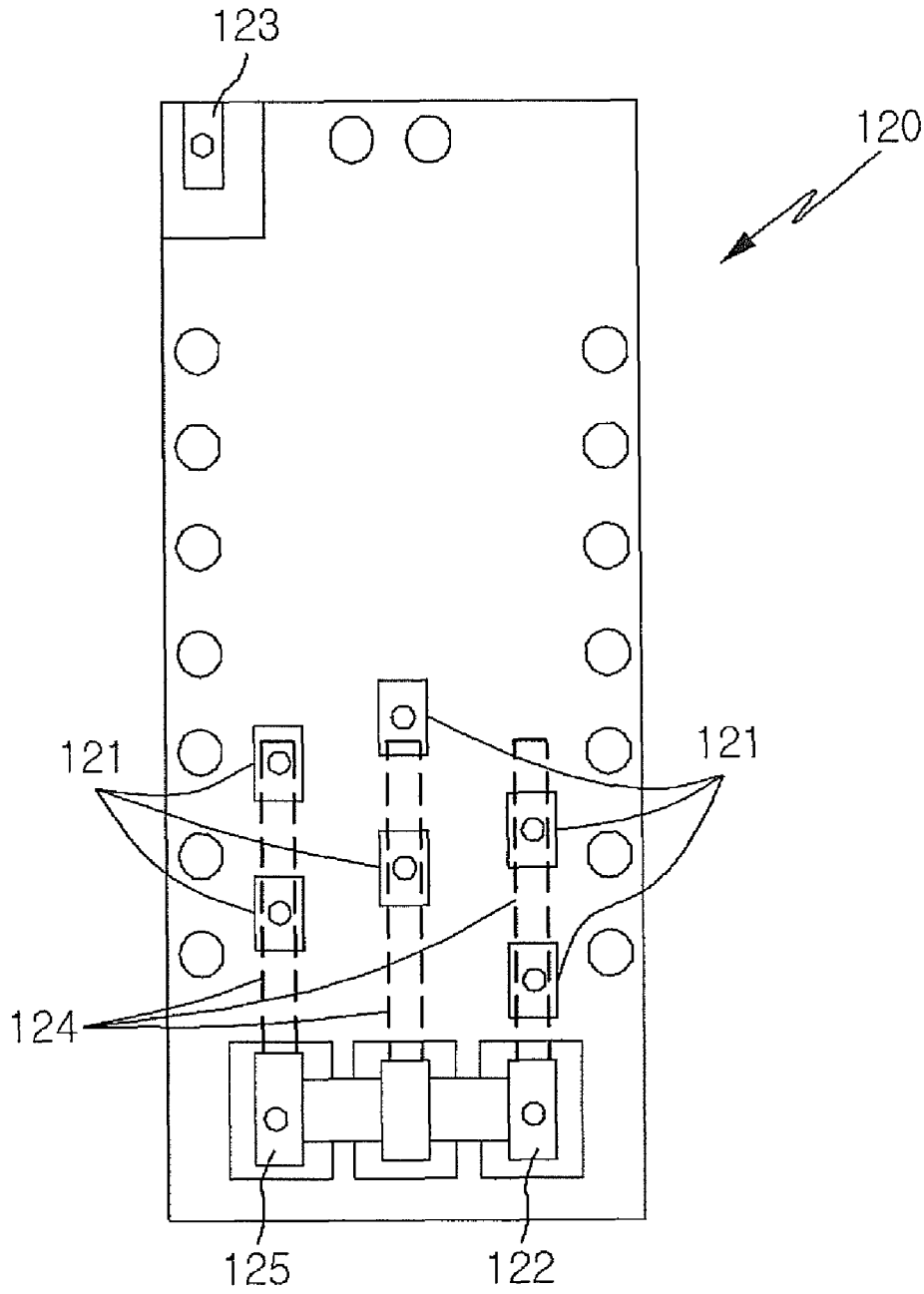

【fig. 4b】
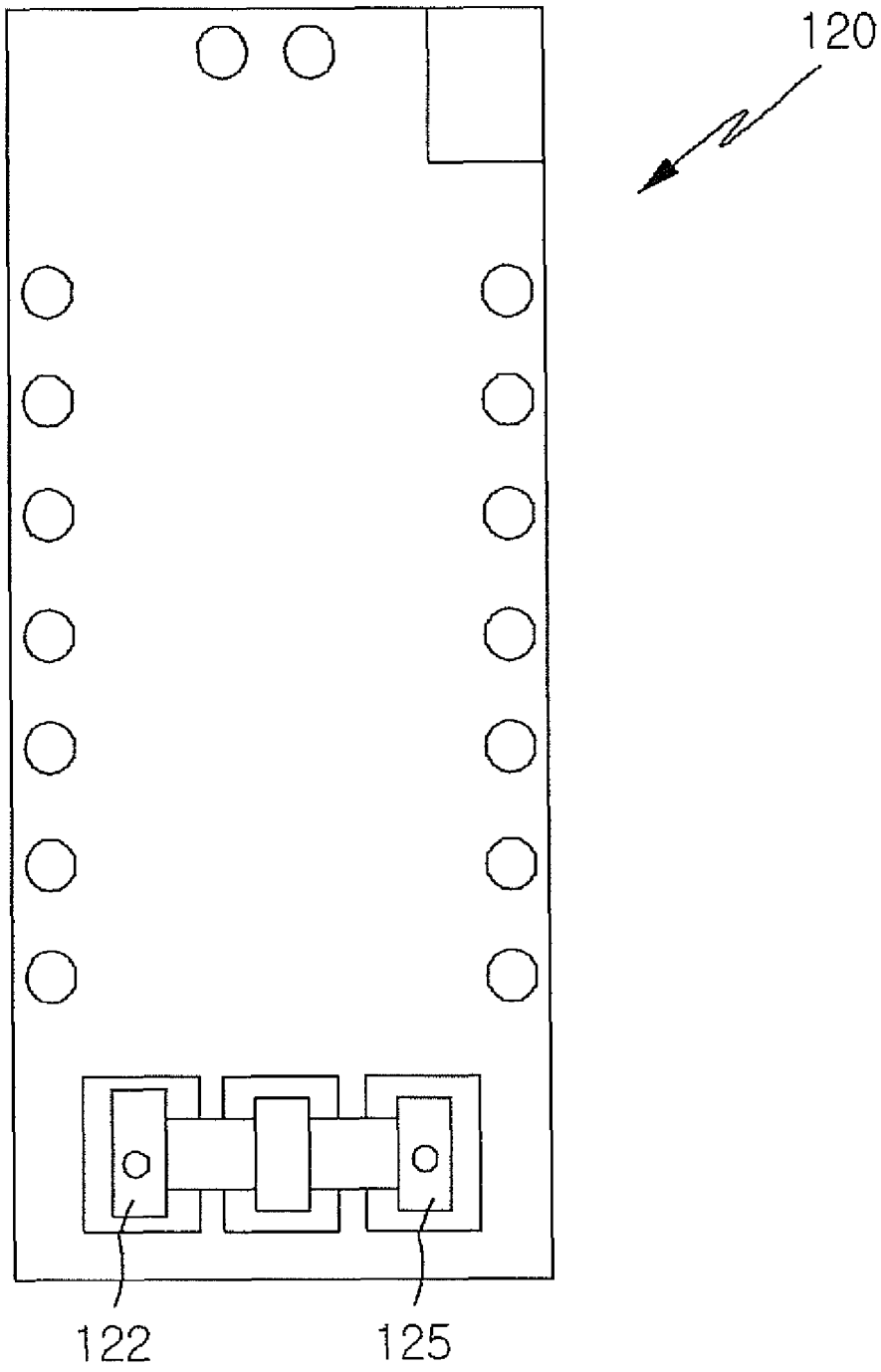

【fig. 5】
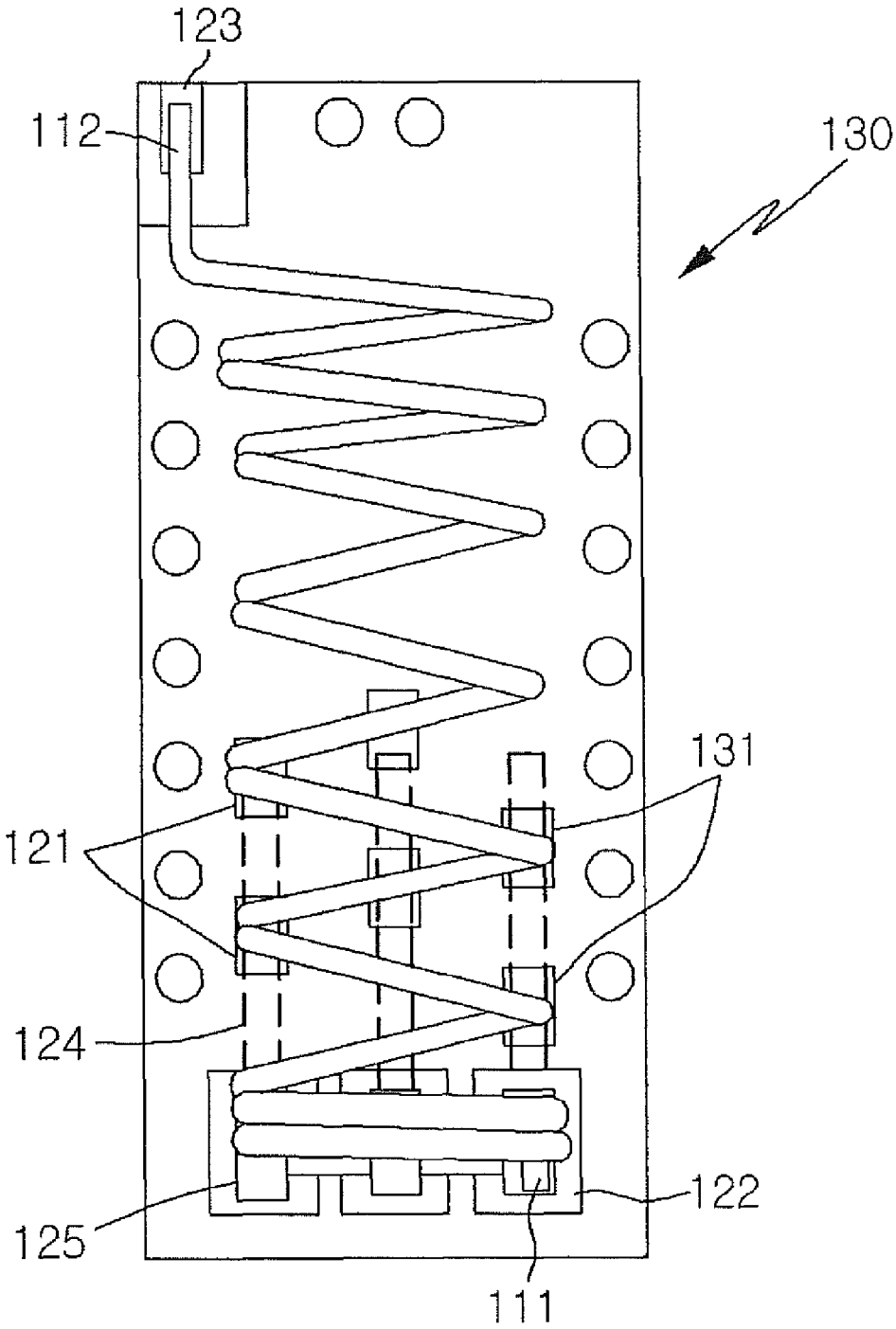

【fig. 6】
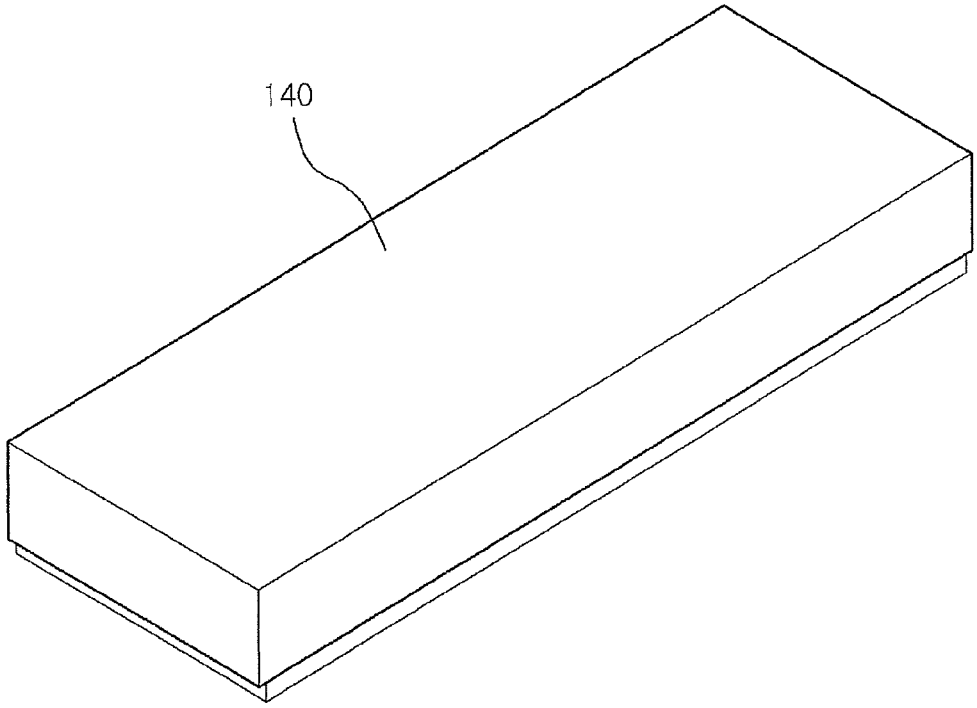

【fig. 7】
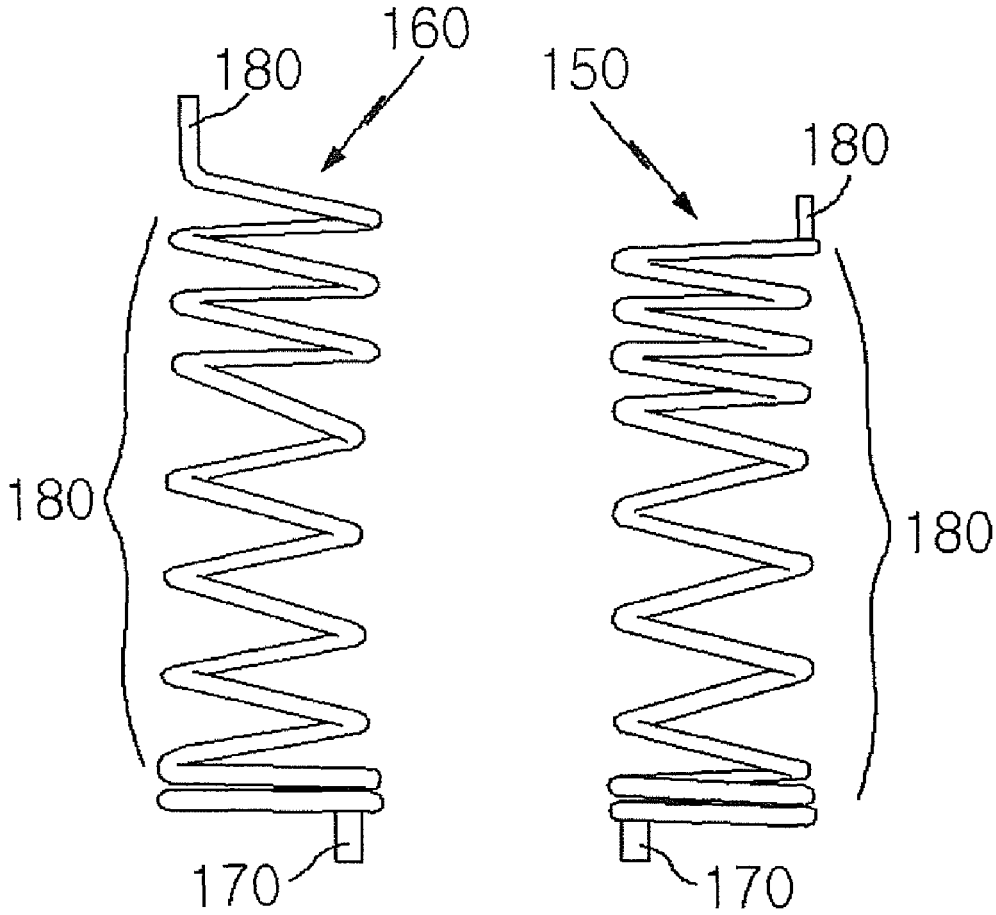

【fig. 8a】
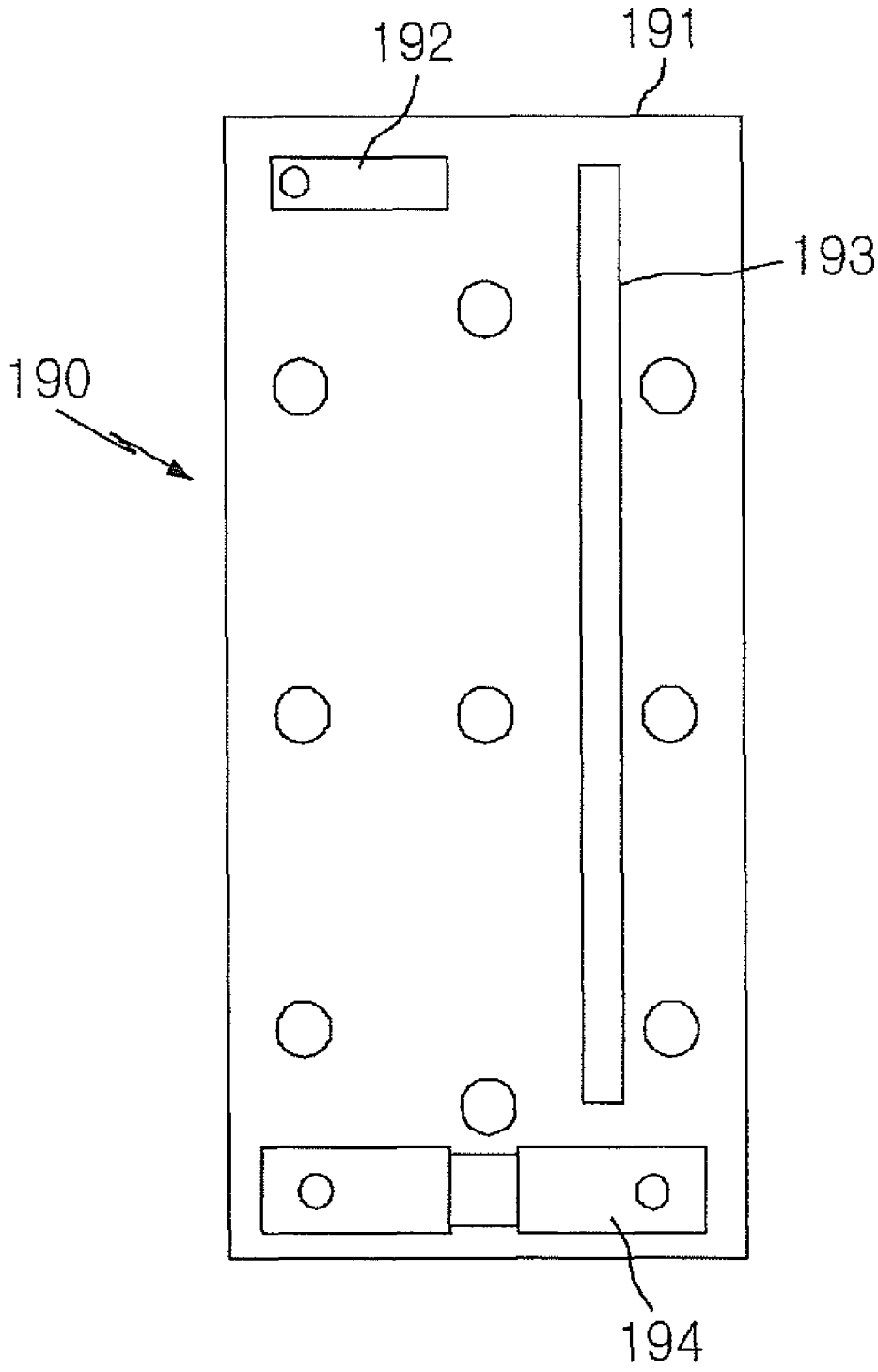

【fig. 8b】
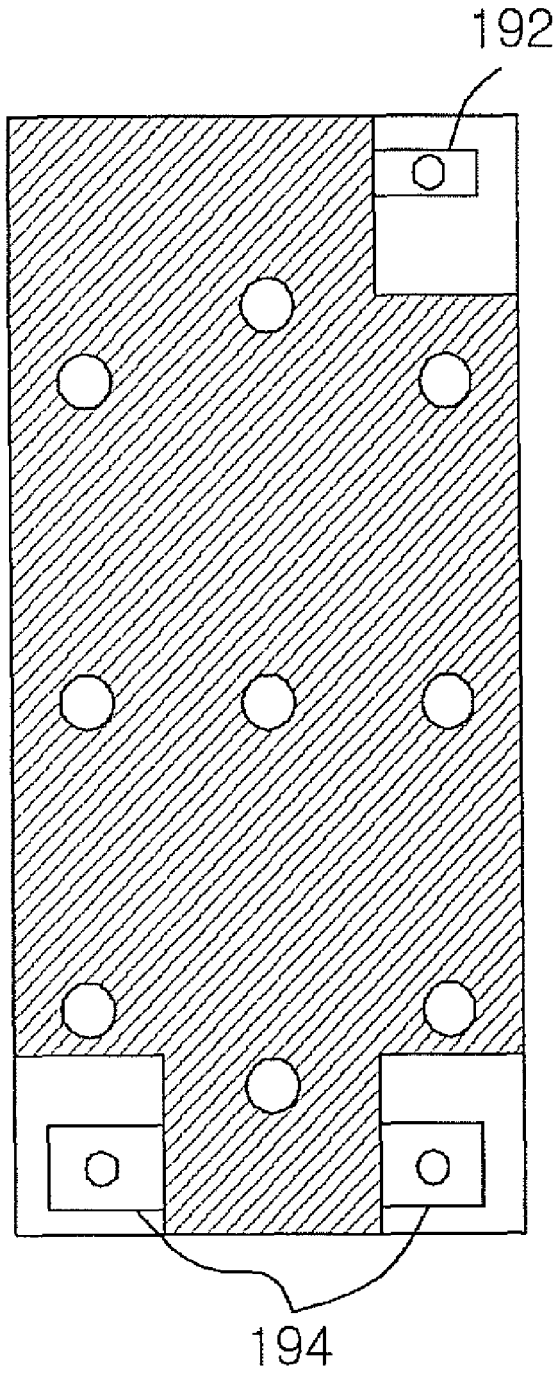

【fig. 9】
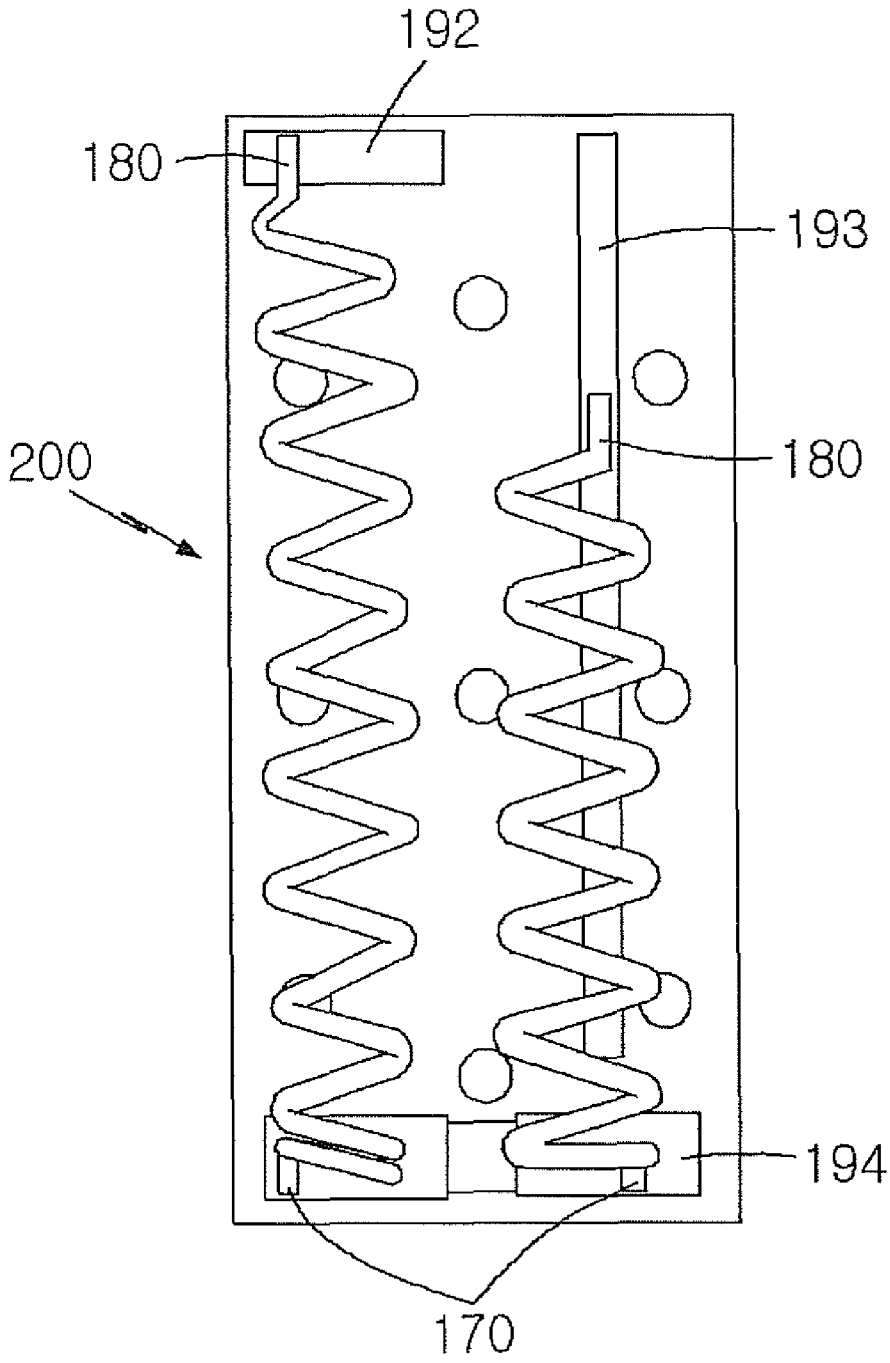

【fig. 10】
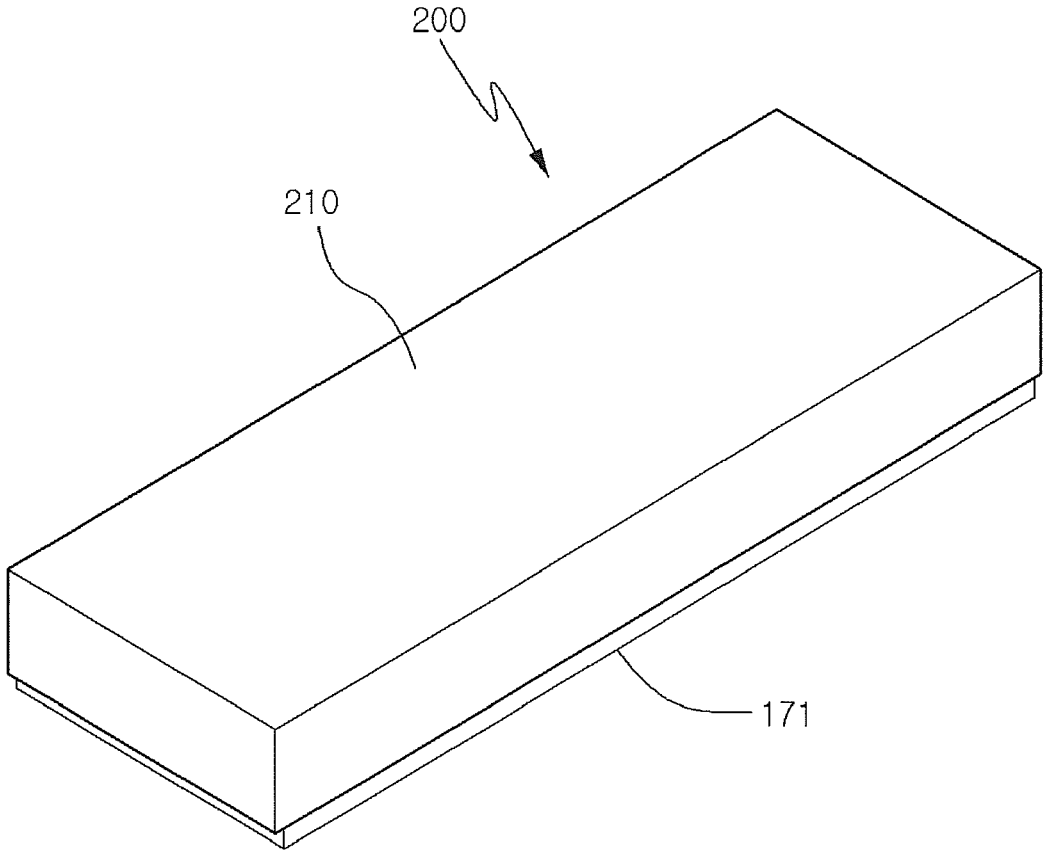

【fig. 11】
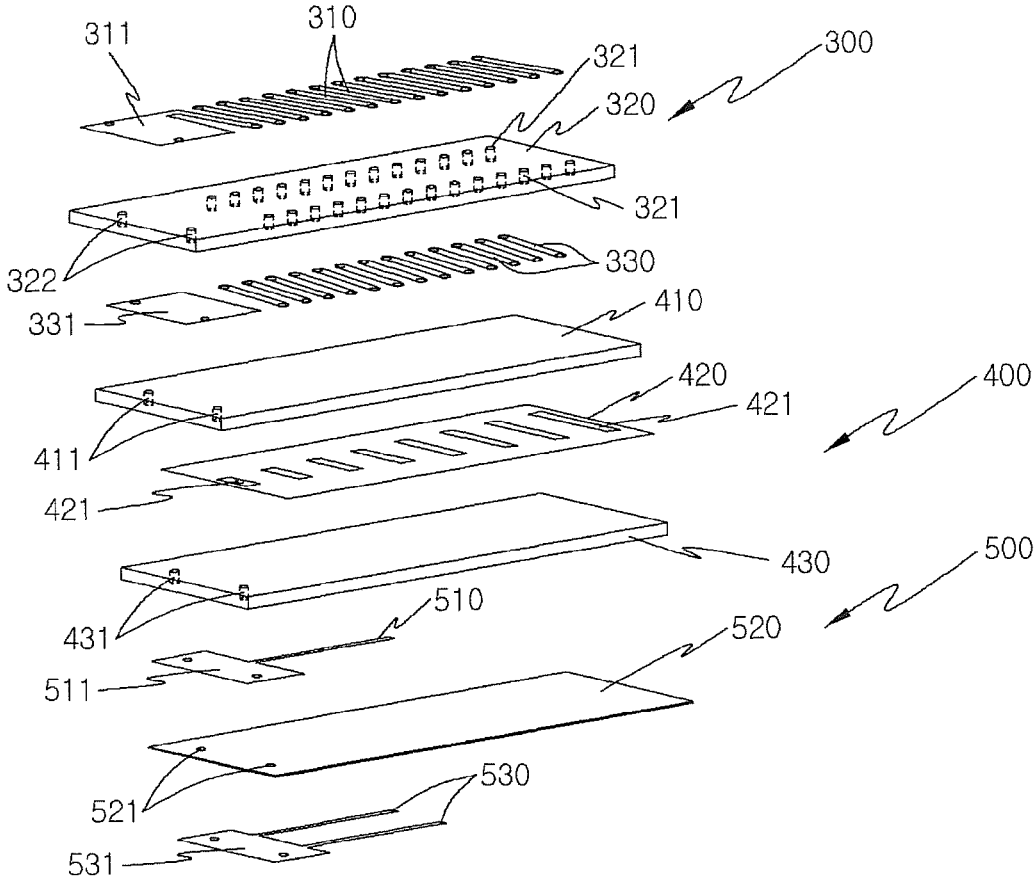

【fig. 12】
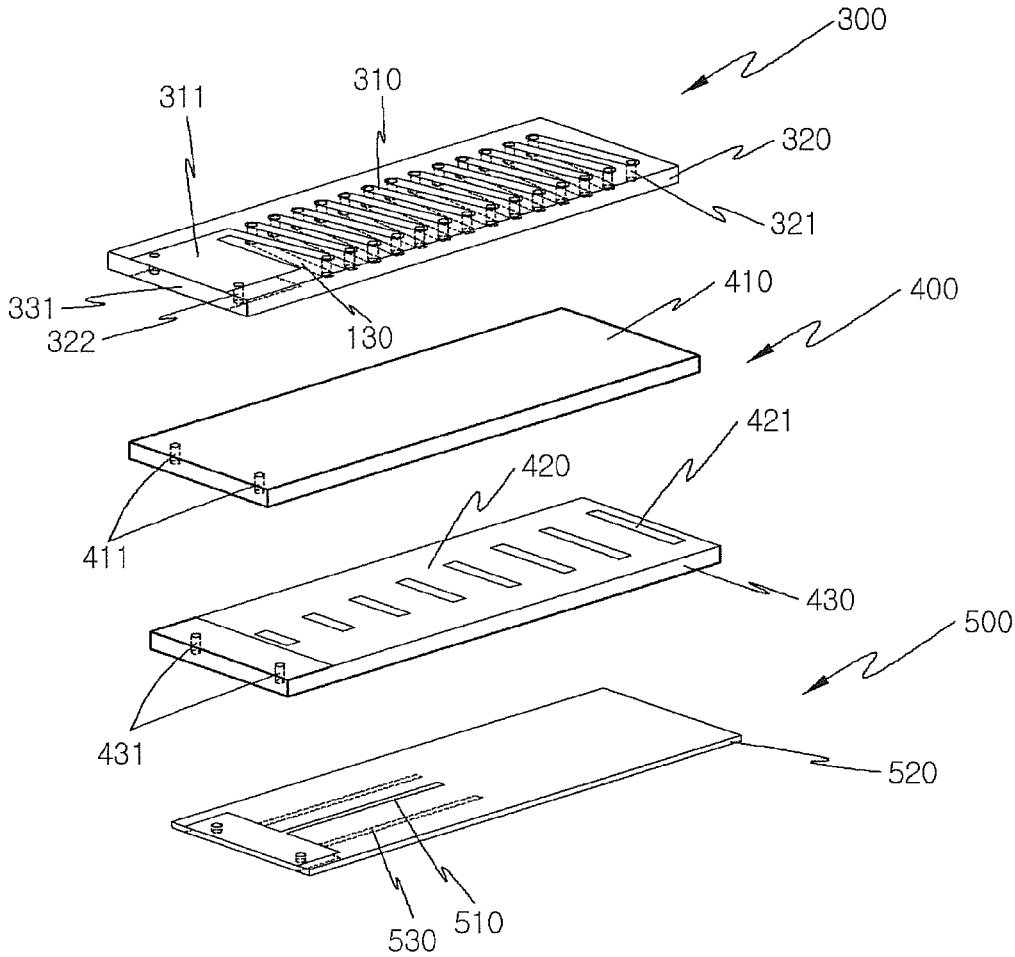

【fig. 13】
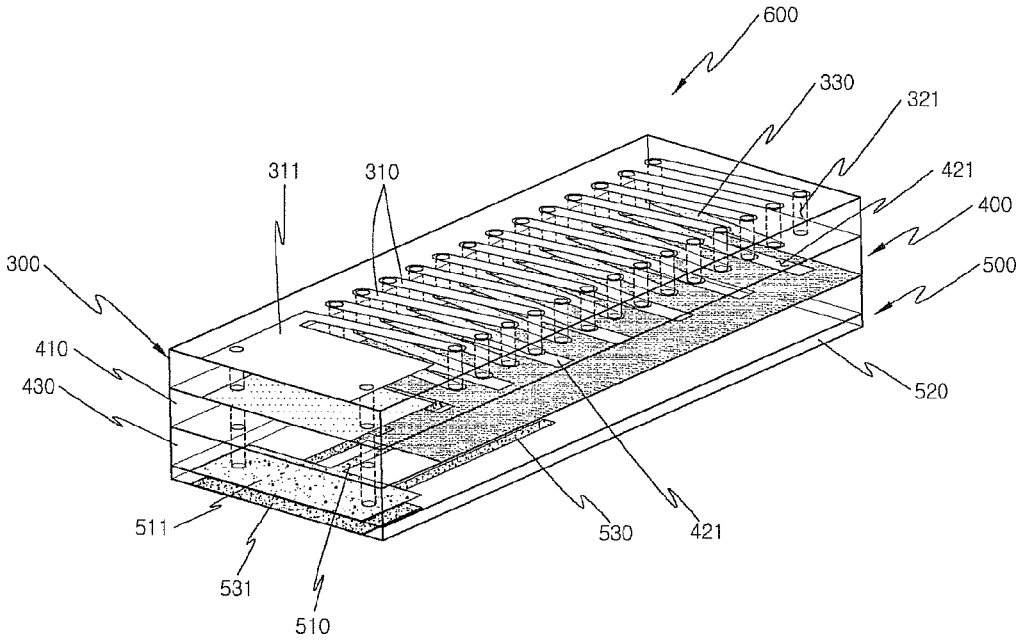

CHIP ANTENNA

TECHNICAL FIELD

The present invention relates in general, to a chip antenna and, more particularly, to a dual-band small-sized chip antenna, in which a first antenna element, including a plurality of coil members, is coupled with a second antenna element, having a plurality of circuit patterns, in a zigzag fashion, thus forming resonance frequencies, and the wavelengths of the resonance frequencies are reduced by molding a dielectric around the first and second antenna elements, thus reducing the size of the antenna and preventing the antenna from being deformed due to high temperature at the time of mounting the antenna and, relates to a multi-band chip antenna, in which first and second antenna elements, forming different resonance frequency bands depending on the lengths of coil members, are connected to a third antenna element, forming a resonance frequency band depending on the length of a circuit pattern formed on a layered substrate, thus being capable of being used in multiple frequency bands and, relates to chip antenna using multi-layer radiator to generate the mutual coupling of two radiator by placing non-feeding radiation element having fixed pattern between the radiator for performing the radiation of the low frequency band and the radiator for performing the radiation of the high frequency band and to have wide band characteristic by forming multiple current path to radiator.

BACKGROUND ART

FIG. 1 is a view showing the construction of a conventional surface-mount chip antenna 10.

As shown in FIG. 1, the conventional surface-mount chip antenna 10 includes a dielectric block 11 made of ceramic material or resin. The dielectric block 11 includes a ground electrode 14 formed on the first surface 12 thereof, a radiation electrode 19 formed on the second surface 13 thereof, and a feeding pattern 15 formed across a portion of one side of the dielectric block 11 from a portion of the first surface 12. The radiation electrode 19 is spaced apart from the feeding pattern 15 and is connected to the ground electrode 14 via two short circuit portions 16 and 17 that are respectively formed on two sides of the dielectric block 11. Furthermore, the radiation electrode 19 has a length of $\lambda/4$ at a resonance frequency.

The surface-mount chip antenna 10 described above forms a resonance circuit using capacitance existing between the ground electrode 14 and the radiation electrode 19 and the inductance of the radiation electrode 19, and adjusts the resonance frequency by coupling the radiation electrode 19 with the feeding pattern 15 using the capacitance existing between the feeding pattern 15 and the radiation electrode 19. However, there is a problem in that it is difficult to provide multi-frequency band communication service because an electrode appropriate to a specific resonance frequency is formed through a certain pattern-forming process and then only a single frequency band is used as a usable frequency band.

FIG. 2 is a view showing the construction of a conventional ceramic chip antenna.

As shown in FIG. 2, the conventional ceramic chip antenna 20 includes a chip main body 21 formed by stacking a plurality of green sheets, which are made of a ceramic dielectric material, a first helical conductor 22 formed in the chip main body 21 in a helical form, and a second helical conductor 23 disposed in parallel with the first helical conductor 22 in the chip main body 21 and formed in a helical form. The first helical conductor 22 is formed using a plurality of horizontal and vertical strip lines in a helical form, and the helical rotational axis A of the first helical conductor 22 is parallel to the bottom 24 and side surfaces 25 of the chip main body 21 made of ceramic. In the same manner, the second helical conductor 23 is formed using a plurality of horizontal and vertical strip lines in a helical form, and the helical rotational axis B of the second helical conductor 23 is parallel to the bottom 24 and side surfaces 25 of the chip main body 21.

In this case, the first helical conductor 22 and the second helical conductor 23 are independently formed without being connected to each other, the helical rotational axes A and B of the conductors 22 and 23 are parallel to each other, and the strip lines and via holes in the respective green sheets are three-dimensionally connected to each other through precise alignment so that the first and second helical conductors 22 and 23 are formed.

Furthermore, voltage supply terminals 26 are formed at respective ends of the helical conductors 22 and 23 so as to protrude outside the main body 21. In this case, if voltage is applied to the helical conductors 22 and 23 through the voltage supply terminals 26, a problem occurs in that the helical conductors 22 and 23 resonate in two different frequency bands, and thus it is difficult to provide multiple frequency band radio communication service.

Although the conventional ceramic chip antenna described above has recently been developed to the level at which it is possible to contain the antenna in a mobile terminal in the form of a small-sized chip, there are problems in that a ceramic material exhibiting a high permittivity is used, therefore the manufacturing cost of the antenna is high and the resonance frequency band thereof varies due to high-temperature sensitivity.

Current mobile communication terminal becomes small-sized and light-weighted and require the diverse service-providing function.

In order to satisfy above demand, the built-in circuit and the components adapted in mobile communication terminal become multi-functioned and at the same time small-sized.

Such trend is identically required to the antenna which is one of important components of the mobile communication terminal.

As antenna for mobile communication terminal used in general, a built-out helical antenna, planar antenna (MPA) of a built-in planar inverted F antenna (PIFA) and ceramic chip antenna are employed.

The helical antenna is used together with monopole antenna as built-out antenna fixed on upper part of the terminal.

In the form in which the helical antenna and the monopole antenna are used together, if the antenna is extracted from terminal main body, it operates as the monopole antenna, and if inserted, it operates as $\lambda/4$ helical antenna.

These antennas have advantage in that these get high gain but have disadvantage in that specific absorption rate (SAR) is not good due to non-directivity.

In other words, so as to overcome these problems, the MPA of the planar inverted F antenna (PIFA) having low profile structure or the ceramic chip antenna is provided.

The above MPA of PIFA type and ceramic chip antenna are built-in antenna. Since it is configured within inner part of the mobile communication terminal, the outward appearance of the mobile communication terminal can be designed finely and can be durable from external impact.

The above MPA of the PIFA type and the ceramic chip antenna are developed into dual band antenna form of the double radiator responsible for mutually different frequency band, that is high frequency band and low frequency band according to multi-function trend.

The performance of the above MPA is somewhat lower than that of the built-out antenna. But it has advantage in that it is embedded, so it has developed successively up to now. And it has disadvantage in that space insurance is not easy due to large size (35*20*6) and the structure must be changed whenever the mobile communication terminal is changed, and cost is high with respect to structure.

Further the ceramic chip antenna has small size and high efficiency. But it is disadvantage in that it is too sensitivity from external factor due to narrow bandwidth and the cost is high.

DISCLOSURE

Technical Problem

Accordingly, the present invention has been made keeping in mind the above problems occurring in the prior art, and an object of the present invention is to provide a dual-band small-sized chip antenna, in which a first antenna element, including a plurality of coil members, is coupled with a second antenna element, having a plurality of circuit patterns, in a zigzag fashion, thus forming resonance frequencies.

The object of the present invention is provide a dual-band small-sized chip antenna, which reduces the wavelengths of the resonance frequencies by molding a dielectric around the first and second antenna elements, thus reducing the size of the antenna and preventing the antenna from being deformed due to high temperature.

Another object of the present invention is to provide a multi-band chip antenna, in which third and fourth antenna elements, forming different resonance frequency bands depending on the lengths of coil members, are connected to a fifth antenna element, forming a resonance frequency band depending on the length of a circuit pattern formed on a layered substrate, thus being capable of being used in multiple frequency bands.

Another object of the present invention is to provide a multi-band chip antenna in which the wavelengths of resonance frequencies are reduced by covering the antenna with a molded dielectric, thus reducing the size of the antenna and preventing the antenna from being deformed due to high temperature.

Another object of the present invention is to provide a chip antenna using multi-layer radiator to generate the mutual coupling of two radiator by placing non-feeding radiation element having fixed pattern between the radiator for performing the radiation of the low frequency band and the radiator for performing the radiation of the high frequency band and capable of minimizing the size and covering wide bandwidth by forming multiple current path.

Technical Solution

In order to accomplish the above objects, the present invention provides a dual-band small-sized chip antenna, including a first antenna element formed of rectangular-shaped dual-pitch coil members connected in a zigzag fashion; and a second antenna element connected to the first antenna element and configured to have a plurality of circuit patterns; wherein the first antenna element and the second antenna element are coupled to each other, so that a dual-frequency band is formed.

According to an embodiment of the present invention, the first antenna element includes a band portion formed of coil members having different pitches; a feeding portion fed with current at one end of the band portion; and an output unit configured to output current fed from the remaining end of the band portion.

According to an embodiment of the present invention, the band portion includes a first band portion having a predetermined pitch; and a second band portion having a pitch different from that of the first band portion.

According to an embodiment of the present invention, the second antenna element is formed on a layered substrate.

According to an embodiment of the present invention, a feeding pattern for feeding current and an output pattern for outputting current are formed on a top surface of the layered substrate.

According to another embodiment of the present invention, multi-band chip antenna includes a third antenna element configured to have one or more coil members formed in a helical form; a fourth antenna element formed parallel to the third antenna element in a helical form; and a fifth antenna element configured to have a plurality of circuit patterns and to be connected with the third antenna element and the fourth antenna element; wherein multiple resonance frequency bands are formed using the respective antenna elements.

According to another embodiment of the present invention, each of the third and fourth antenna elements includes a feeding portion configured to feed current to the coil members; a band portion configured to form a resonance frequency band using the feeding portion; and an output portion configured to output current fed from the band portion.

According to another embodiment of the present invention, the band portion of the third antenna element forms a resonance frequency band using predetermined pitches.

According to another embodiment of the present invention, the band portion of the fourth antenna element forms a resonance frequency band using pitches that are different from those of the third antenna element.

According to another embodiment of the present invention, the fifth antenna element is formed on a layered substrate.

According to another embodiment of the present invention, a feeding pattern, which is configured to feed current, a band pattern, which is fed with the current and forms a resonance frequency depending on length of a circuit pattern, and a ground pattern are formed on a top surface of the layered substrate.

According to still another embodiment of the present invention, the chip antenna comprises first radiator, second radiator electrically connected to the first radiator and non-feeding radiation element for placing between the first radiator and the second radiator and mutually being coupled from the first radiator and the second radiator to be fed with current According to still another embodiment of the present invention, one or more slit extending resonant frequency bandwidth of the first radiator and the second radiator is formed respectively in the non-feeding radiation element.

According to still another embodiment of the present invention, the slot has a physical length so that it resonates at frequency adjoining at resonance frequency of the first radiator and the second radiator.

According to still another embodiment of the present invention, the second radiator has wide band characteristic by forming multiple current path with multi-layer structure.

According to still another embodiment of the present invention, the second radiator has same physical length up and down of dielectric substrate but comprises a plurality of radiators of which resonance frequency differs due to thickness of the dielectric substrate.

According to still another embodiment of the present invention, the first radiator is configured so that first radiation pattern and second radiation pattern are formed up and down of the dielectric substrate in which a plurality of via holes are formed and has structure of zigzag line to which the first radiation pattern and the second radiation pattern are connected through via hole.

According to still another embodiment of the present invention, the first radiator, the non-feeding radiation element and the second radiator are molded with Liquid Crystalline Polymer (LCP) dielectric.

Advantageous Effects

According to the present invention, the first antenna element, including rectangular-shaped dual-pitch coil members having a predetermined pitch, is coupled with the second antenna element, having a plurality of circuit patterns, in a zigzag fashion, and is fed with current, so that dual-band resonance frequencies can be formed.

Furthermore, the wavelengths of the resonance frequencies are reduced by molding a dielectric around the first and second antenna elements, so that the size of the antenna can be reduced and the antenna can be prevented from being deformed due to high temperature.

According to the present invention, the third and fourth antenna elements, which form different resonance frequency bands depending on the lengths of coil members, are connected to the fifth antenna element, which forms a resonance frequency band depending on the length of a circuit pattern formed on the layered substrate, so that multiple resonance frequency bands can be acquired.

Furthermore, the wavelengths of resonance frequencies are reduced by covering the antenna with a molded dielectric, so that the size of the antenna can be reduced and the antenna can be prevented from being deformed due to high temperature.

According to the present invention, the size of the total antenna can be reduced by layered structure of the first radiator and the second radiator having multiple layer structure, and the bandwidth can be extended by placing the non-feeding radiation element having different pattern by bandwidth between the first radiator and the second radiator and forming multiple current path in the radiator.

Further, because the chip antenna can be mounted with Surface Mount technology (SMT) in the Printed Circuit Board (PCB), the mounting to set is easy and the manufacturing cost is lower than that of conventional antenna.

DESCRIPTION OF DRAWINGS

FIG. 1 is a view showing the construction of a conventional surface-mount chip antenna;

FIG. 2 is a view showing the construction of a conventional ceramic chip antenna;

FIG. 3 is a view showing the construction of a first antenna element according to an embodiment of the present invention;

FIG. 4A is a front view showing the construction of a second antenna element according to an embodiment of the present invention;

FIG. 4B is a rear view showing the construction of the second antenna element according to the embodiment of the present invention;

FIG. 5 is a view showing the construction of a dual-band small-sized chip antenna according to an embodiment of the present invention;

FIG. 6 is a view showing the construction of a dual-band small-sized chip antenna, which is covered with a molded dielectric, according to an embodiment of the present invention;

FIG. 7 is a view showing the construction of third and fourth antenna elements according to an embodiment of the present invention;

FIG. 8A is a front view showing the construction of a fifth antenna element according to an embodiment of the present invention;

FIG. 8B is a rear view showing the construction of the fifth antenna element according to the embodiment of the present invention;

FIG. 9 is a view showing the construction of a multi-band chip antenna according to an embodiment of the present invention;

FIG. 10 is a view showing a multi-band chip antenna, which is covered with a molded dielectric, according to an embodiment of the present invention;

FIG. 11 is a perspective view showing the chip antenna decomposition according to an embodiment of the present invention;

FIG. 12 is a perspective view showing decomposition by layer of the chip antenna according to the FIG. 11; and FIG. 13 is a perspective view showing inner structure of the chip antenna assembled according to the FIG. 11.

BEST MODE

Preferred embodiments of the present invention are described in detail with reference to the accompanying drawings below.

The small-sized chip antenna using a dual radiator according to the present invention includes a first antenna element formed of a plurality of coil members that are connected in a zigzag fashion, and a second antenna element configured such that a plurality of circuit patterns is provided on a layered substrate and is connected to the first antenna element.

FIG. 3 is a view showing the construction of a first antenna element 100 according to an embodiment of the present invention.

As shown in FIG. 3, the first antenna element 100 includes a band portion 110 formed of coil members having different pitches, a feeding portion 111 fed with current at one end of the band portion 110, and an output portion 112 configured to output current fed from the other end of the band portion 110.

The band portion 110 includes a first band portion 113 formed of rectangular-shaped coil members having a narrow pitch, and a second band portion 114 formed of rectangular-shaped coil members having a pitch wider than that of the first band portion 140.

FIG. 4A is a front view showing the construction of a second antenna element according to an embodiment of the present invention, and FIG. 4B is a rear view showing the construction of the second antenna element according to the embodiment of the present invention.

As shown in FIG. 4A, the second antenna element 120 includes a plurality of connection patterns 121 formed of rectangular patterns on the top surface of the layered substrate, a feeding pattern 122 configured to feed current, and an output pattern 123 configured to output current fed thereto.

Radiation patterns 124, which are formed of three circuit patterns that are connected with the connection patterns 121 through via holes, and a ground pattern 125 are formed in the layered substrate.

Furthermore, as shown in FIG. 4B, the feeding pattern 122 and the ground pattern 125 extend to the bottom surface of the layered substrate through the layered substrate and via holes.

FIG. 5 is a view showing the construction of a dual-band small-sized chip antenna according to an embodiment of the present invention.

As shown in FIG. 5, in the antenna 130, rectangular-shaped dual pitch coil members, which are the first antenna element 100, are coupled with the connection patterns 131 of the second antenna element 120, which are formed on the layered substrate and are coupled with the radiation patterns 124 and the ground pattern 125 that are formed in the layered substrate and fed with current, through the via holes in a zigzag fashion, thereby forming the band portion 110. The band portion 110 is coupled with the feeding portion 111 at one end thereof and the feeding portion 111 is coupled with the feeding pattern 122, so that current can be fed. Meanwhile, the output portion 112 formed at the other end of the band portion 110 is connected with the output pattern 123 formed at an end of the top surface of the layered substrate, so that the current fed to the band portion 110 can flow through the first antenna element 100 and the second antenna element 120, therefore dual-band resonance frequencies are formed according to the lengths of the band portion 110 and the radiation patterns 124.

In this case, the first band portion 113 of the band portion 110, including a plurality of coil members connected at a narrow pitch, forms a resonance frequency having a high frequency range (1540 MHz~2060 MHz), and the second band portion 114, including a plurality of coil members connected at a wide pitch, forms a resonance frequency having a low frequency range (860 MHz~940 MHz), so that desired dual-band resonance frequencies can be acquired.

FIG. 6 is a view showing the construction of a dual-band small-sized chip antenna, which is covered with a molded dielectric, according to an embodiment of the present invention.

As shown in FIG. 6, the dual-band small-sized chip antenna 130 is formed by molding a dielectric 140, for example, thermoplastic polyester (liquid crystalline polymer) exhibiting permittivity, on the layered substrate of the second antenna element 120.

The wavelengths of resonance frequencies are reduced using the dielectric material 140, so that the size of the antenna 130 can be reduced and the antenna 300 can be prevented from being deformed due to high temperature in a Surface Mount Technology (SMT) process.

FIG. 7 is a view showing the construction of third and fourth antenna elements and according to an embodiment of the present invention.

As shown in FIG. 7, each of the third antenna element 150, which is configured to have one or more coil members formed in a helical form, and the fourth antenna element 160, which is formed parallel to the third antenna element 150 in a helical form, includes a feeding portion 170 fed with current at the coil members, a band portion 180 configured to form a resonance frequency band when current is fed from the feeding portion 170, and an output portion 171 configured to output current fed from the band portion 180.

The band portion 180 of the third antenna element 150 forms a resonance frequency band using predetermined narrow pitches, and the band portion 180 of the fourth antenna element 160 forms a resonance frequency band using pitches wider than those of the third antenna element 150.

FIG. 8A is a front view showing the construction of a fifth antenna element according to an embodiment of the present invention, and FIG. 8B is a rear view showing the construction of the fifth antenna element according to the embodiment of the present invention.

As shown in FIG. 8A, the fifth antenna element 190 includes a feeding pattern 192 formed on the top surface of a layered substrate 191 in the form of a rectangular-shaped circuit pattern and configured to be fed with current, a band pattern 193 fed with the current from the feeding pattern 192 and configured to form a resonance frequency band depending on the length thereof, and a ground pattern 194.

Furthermore, as shown in FIG. 8B, the feeding pattern 192 and the ground pattern 194 extend to the bottom surface of the layered substrate 191 through the layered substrate 310 and via holes.

FIG. 9 is a view showing the construction of a multi-band chip antenna according to an embodiment of the present invention.

As shown in FIG. 9, in the multi-band chip antenna 400, the feeding portions 170 of the third antenna element 150, which is configured to have one or more coil members formed in a helical form, and the fourth antenna element 160, which is formed parallel to the third antenna element 150, are connected to the feeding pattern 192 of the fifth antenna element 190, which is formed on the top surface of the layered substrate 191 and is externally fed with current, so that the current flows through the band portions 180 of the third antenna element 150 and the fourth antenna element 160, therefore resonance frequency bands depending on the lengths of the coil members are formed. The ground pattern 194 of the fifth antenna element 190 is connected with the output portions 171 of the third and fourth antenna elements 150 and 160, thereby allowing the output current to flow to ground.

In this case, the band portion 180 of the third antenna element 150 forms a resonance frequency band (1540 MHz~2060 MHz) using coil members having narrow pitches, and forms a resonance frequency band (880 MHz~960 MHz) using coil members having wide pitches. Furthermore, the output portion 171 of the third antenna element 150 is connected to the band pattern 193 of the fifth antenna element 193, so that the current is transferred, therefore a resonance frequency band (2400 MHz) depending on the length of a circuit pattern is formed. Accordingly, desired multiple resonance frequency bands can be acquired.

FIG. 10 is a view showing a multi-band chip antenna, which is covered with a molded dielectric, according to an embodiment of the present invention.

As shown in FIG. 10, the multi-band chip antenna 200 is formed by molding a dielectric 210, for example, thermoplastic polyester (liquid crystalline polymer) exhibiting permittivity, on the layered substrate 191 of the fifth antenna element 190, on the top surface of which the third antenna element 150 and the fourth antenna element 160 are provided.

The wavelengths of resonance frequencies are reduced using the dielectric 210, so that the size of the multi-band chip antenna 200 can be reduced and the multi-band chip antenna 200 can be prevented from being deformed due to high temperature in a Surface Mount Technology (SMT) process.

FIG. 11 is a perspective view showing the chip antenna decomposition according to an embodiment of the present invention; and FIG. 12 is a perspective view showing decomposition by layer of the chip antenna according to the FIG. 11; and FIG. 13 is a perspective view showing inner structure of the chip antenna assembled according to the FIG. 11.

As shown in FIG. 13, the chip antenna comprises the first radiator 300, the non-feeding radiation element 400, and the second radiator 500.

The first radiator 300 and the second radiator 500 embody a resonance length. The non-feeding radiation element 400 extends the bandwidth of frequency which is desired.

The first radiator 300 performs the radiation of low frequency band, for example about 900 MHz band.

The first radiator 300 comprises the first, the second radiation pattern 310 and 330, and the first dielectric substrate 320.

The first radiation pattern 310 and the second radiation pattern 330 are formed up and down of the first dielectric substrate 320 having a plurality of via holes 321.

Then, in order to acquire a electrical length (resonance length) capable of performing the radiation of low frequency band, the first radiator 300 has a structure of zigzag line to which the first radiation pattern 310 and the second radiation pattern 330 are connected each other through via holes 321.

Further, the first radiator 300 prints a conductor band corresponding to the electrical length on upper and lower surface of the first dielectric substrate 320, and forms the first radiation pattern 310 and the second radiation pattern 330, thus can embody them by connecting each other.

Each of feeding line 311 and 331 connected to the first radiation pattern 310 and the second radiation pattern 330 is connected electrically through via holes 322 formed on the first dielectric substrate 320.

The non-feeding radiation element 400 placed between the second radiator 500 and the first radiator 300 is not connected electrically to any feeding line, and for generating a mutual coupling with two radiators 300 and 500, determine a desirable bandwidth by frequency band.

The non-feeding radiation element 400 comprises the second, the third dielectric substrate 410 and 430, and non-feeding element pattern 420 of conducting material.

In order to extend further bandwidth of the frequency radiated at the first radiator 300 and the second radiator, the non-feeding radiation element 400 is provided between non-feeding element pattern 420, the second dielectric substrate 410 and the third dielectric substrate 430 in which at least two or more slits 421 are formed.

Among slots 421, the slot for existing on the left extends further the bandwidth of the high frequency radiated from the second radiator 500 and the slot for existing on the right extends further the bandwidth of the low frequency radiated from the first radiator 300.

If a plurality of slots 421 extending the high frequency or the low frequency bandwidth are configured, a radiation gain and a radiation pattern become better than those having each one formed.

The physical length of the slot 421 is determined to resonate at frequency adjoining to the frequency radiated from the first radiator 300 and the second radiator 400.

The second radiator 500 performs the radiation of the wide band high frequency as multiple structures.

The second radiator 500 forms the third radiation pattern 510 and the fourth radiation pattern 530 up and down of the fourth dielectric substrate 520.

Though the physical length of the third radiation pattern 510 and the fourth radiation 530 is same, because resonance frequency band becomes different due to inter-layer difference by thickness of the dielectric substrate 520, thus it can improve the bandwidth of the high frequency.

In the second radiator 500, the feeding line 531 of the fourth radiation pattern 530 has a structure connected to the feeding line 511 connected to the third radiation pattern 510 through the via holes 521 of the fourth dielectric substrate 520, that is a structure in which a current path of the second radiator 500 is diversified, so that the high frequency bandwidth can be improved.

The third feeding line 511 is connected to the feeding line 311 connected to the first radiation pattern 310 through a via hole 431 of the third dielectric substrate 430, a via hole 411 of the second dielectric substrate 410 and a via hole 322 of the feeding line 331 and the first dielectric substrate 320, and the first radiation pattern 310 is connected to lower second radiation pattern 330 through via hole 321 of the first dielectric substrate 320.

Each of radiation pattern 510, 530 provided in the second radiator 500 improves the high frequency bandwidth due to diversification of the current path and radiates, and the high frequency bandwidth is further extended and radiated through the slot 421 existing on the left of the non-feeding radiation element 420.

The first and the second radiation pattern 310, 330 provided in the first radiator 300 radiates the low frequency bandwidth, and this low frequency bandwidth is extended and radiated through the slot 421 existing on the right of the non-feeding radiation element 400.

As described above, the first radiator 300, the non-feeding radiation element 400 and the second radiator 500 are assembled and the manufacture of the chip antenna 600 is finished by molding with Liquid Crystal Polymer (LCP) dielectric.

By above structure, the non-feeding radiation element 400 having fixed pattern between the first radiator 300 and the second radiator 500 is provided and mutual coupling with two radiator 300, 500 is generated and thus wider bandwidth is ensured by forming the multiple current path to radiator.

The plastic material of relative permittivity ($\in_r$) within range of 2 to 4 with above LCP dielectric is used so that the size of the chip antenna 600 (20*7*4*) can be reduced by reducing wavelength of the using frequency. Since heat-resisting temperature is beyond 300°, the deformation of the chip antenna 600 can be prevented on Surface Mount technology (SMT) mounting the chip antenna 600 on the PCB.

According to above reduction of the size, the structural problem that the conventional planar antenna (MPA) is used limitedly is solved and the standing wave ratio and the performance of the radiation pattern can be improved.

According to the existence of the LCP dielectric, the variation of the frequency transfer of 100~150 MHz is generated.

Referring to bandwidth, the bandwidth over about 80 MHz in the low frequency of 900 MHz and the bandwidth over about 600 MHz in the high frequency of 1800 MHz can be insured (reference stand wave ratio VSWR<3:1)

Though the radiation pattern 311,331,511 and 531 of the first radiator 300 and the second radiator 500 are connected electrically through the via holes 322,411,431 and 521 of the dielectric substrate 320,410,430 and 520, those can be connected electrically by printing the feeding line and the ground line at the one side of the dielectric substrate.

The best embodiment is disclosed in the drawing and the detailed description and the specific term used above is only used for purpose explaining the present invention. It is not used for meaning limitation or for limiting the scope of the present invention mentioned in claims.

Although the preferred embodiments of the present invention have been disclosed for illustrative purpose, those skilled in the art will appreciate that various modification, additions and substitutions are possible, without departing from the scope and spirit of the invention as claimed in the accompanying claims.

The invention claimed is:

1. A chip antenna, comprising:

a first radiator;

a second radiator electrically connected to the first radiator; and a non-feeding radiation element placed between the first radiator and the second radiator and mutually being coupled from the first radiator and the second radiator to be fed with current, wherein the non-feeding radiation element has at least two slots, and the at least two slots extending resonance frequency bandwidth of the first radiator and the second radiator are formed respectively in the non-feeding radiation element.

2. The chip antenna according to claim 1, wherein each of the at least two slots has a physical length so that it resonates at frequency adjoining to resonance frequency of the first radiator and the second radiator.

3. The chip antenna according to claim 1, wherein the second radiator has wide band characteristic by forming multiple current path with multi-layer stricture.

4. The chip antenna according to claim 3, wherein the second radiator has same physical length up and down of dielectric substrate but comprises a plurality of radiators of which resonance frequency differs due to difference of thickness of the dielectric substrate.

5. The chip antenna according to claim 1, wherein the first radiator, the non-feeding radiation element and the second radiator are molded with Liquid Crystalline Polymer (LCP) dielectric.

6. The chip antenna, comprising:

a first radiator;

a second radiator electrically connected to the first radiator; and a non-feeding radiation element placed between the first radiator and the second radiator and mutually being coupled from the first radiator and the second radiator to be fed with current, wherein the first radiator is configured so that first radiation pattern and second radiation pattern are formed up and down of the dielectric substrate in which a plurality of via holes are formed and has structure of zigzag line to which the first radiation pattern and the second radiation pattern are connected through via hole.

* * * * *